US005669435A

United States Patent [19]

Goss

[11] Patent Number: 5,669,435

[45] Date of Patent: Sep. 23, 1997

[54] APPARATUS AND METHOD FOR REMOVING INVESTMENT MATERIAL FROM AN INVESTMENT CASTING

[75] Inventor: Douglas J. Goss, North Kingstown, R.I.

[73] Assignee: Conley Casting Supply Corp., Warwick, R.I.

[21] Appl. No.: 642,694

[22] Filed: May 3, 1996

[51] Int. Cl.[6] ..... B22D 29/00

[52] U.S. Cl. ..... 164/131; 164/464

[58] Field of Search ..... 164/404, 401, 164/131, 132, 39, 203, 71.1, 260, 344, 345

[56] References Cited

U.S. PATENT DOCUMENTS

| | | | |
|---|---|---|---|
| 4,185,681 | 1/1980 | Church et al. | 164/404 |
| 5,201,812 | 4/1993 | Goss | 164/404 |

FOREIGN PATENT DOCUMENTS

| | | | |
|---|---|---|---|
| 62-38754 | 2/1987 | Japan | 164/404 |

*Primary Examiner*—Kuang Y. Lin

*Attorney, Agent, or Firm*—Salter & Michaelson

[57] ABSTRACT

A two-stage investment removal apparatus for removing investment material from an investment casting includes first and second stage sub-assemblies operative for different impacting actions. The first stage sub-assembly includes spaced drive rollers for rotating the investment flask on its side, and a pneumatic hammer which engages the side wall of the investment flask for imparting impact energy to the investment flask while the flask is being rotated. The flask is placed in a protective sleeve which more evenly distributes the impact forces around the side wall of the flask during rotation. The second stage sub-assembly includes a tubular chamber, and a spring-biased seat in the chamber for receiving the bottom end of the central casting trunk when the flask is positioned on the seat. The chamber includes radial spring arms for centering the flask and casting trunk on the seat. The second stage sub-assembly further includes a vertically oriented pneumatic hammer in engagement with the upper end of the central casting trunk for imparting vertical impact energy to the central trunk. The vertical hammer cooperates with the spring biased seat to cause the casting to resiliently resonate and cause the investment molding material to disintegrate apart from the investment casting.

13 Claims, 4 Drawing Sheets

APPARATUS AND METHOD FOR REMOVING INVESTMENT MATERIAL FROM AN INVESTMENT CASTING

BACKGROUND AND SUMMARY OF THE INVENTION

The instant invention relates generally to lost wax investment casting, and more specifically to an apparatus and method for removing investment material from an investment casting.

The lost wax investment casting process is used in the molding of high temperature metals that cannot be molded in rubber. In casting by the lost wax process, preliminary patterns of the parts to be cast are formed by any suitable means, such as rubber molds, from a meltable material such as wax or the like. For example, the wax materials may be introduced under high temperature and pressure into a rubber mold having the desired pattern cavities to produce the desired wax patterns, and thereafter the wax is allowed to cool. After cooling, the wax patterns are removed from the mold and attached to a wax trunk or rod by their runners or gates, thereby forming a tree-shaped wax model. The wax tree model is placed on a circular rubber base and a cylindrical metal flask is then slid over the base. The wax tree is then embedded in a gypsum-based investment material which comprises a gypsum-based powder mixed with water. More specifically, the investment material is mixed, evacuated to remove air pockets, and then poured into the top of the cylinder completely embedding the wax tree therein, and thereafter the investment is allowed to solidify. After the investment solidifies, the wax is removed from the investment flask mold by placing the flask in an oven where the wax is melted and burnt out, leaving the investment flask mold with the desired pattern cavities therein. Casting metal is then introduced into the mold by vacuum or centrifugal techniques, and thereafter, the metal is allowed to harden.

After the metal is hardened, the investment material must be removed from the cylindrical flask and separated from the cast metal tree and parts. Heretofore, investment removal has primarily been accomplished by high pressure water blasting in which high pressure air and water are applied to the ends of an investment flask which is maintained at an elevated temperature. The high pressure of the water and air function to blast away the investment material from the cast parts, and the elevated temperature of the flask creates a steam effect when the water is introduced, thus helping to disintegrate the investment. The cast parts are thereafter sandblasted to remove any remaining investment material after which conventional final finishing operations are employed. Although the water blasting method has proven to be generally satisfactory, the introduction of water to the investment material causes several disposal problems which are readily apparent. The introduction of water to the investment material increases the weight of the waste investment and thus increases disposal costs. In order to dispose of the saturated investment material, the investment material must be separated from the water in settling tanks, and this alone is a lengthy and difficult process. In addition, the investment material may contain trace elements of toxic metal from the casting process, and in turn, waste water from the settling process may contain traces of investment material. Therefore, both the investment material and the waste water must be appropriately disposed of so as to not create environmental concerns.

Investment removal has also been accomplished using dry processes in which the investment mold is pushed out of the flask and then manually pounded to break away and separate the investment material from the cast metal parts. Several problems are readily apparent in the above-described procedure. Manually separating the cast parts is labor intensive and introduces a high degree of risk of damaging the cast parts. In addition, there is also a high percentage of investment left on the parts after manual separation, and thus the parts require more sandblasting than with the wet process.

Still further, an automatic apparatus for removing investment material has heretofore been known in the art. Such apparatus is disclosed in U.S. Pat. No. 5,201,812, which is commonly assigned with the present invention. Pat. No. 5,201,812 discloses an investment removal apparatus wherein horizontal and vertical impact assemblies cooperate with a spring seat assembly to transmit linear, dynamic vibratory impact energy to the investment flask to disintegrate the investment material and release the casting. While this apparatus is highly effective in performing its function, it has been found that there is a market need for a simpler and less costly apparatus which performs the same function.

The instant invention provides a two-stage investment removal apparatus which accomplishes the same job as the prior art apparatus, yet is less costly and more compact than the prior art device. The two-stage investment removal apparatus comprises first and second stage sub-assemblies which are operative for separate impacting operations to remove the investment material. The first stage sub-assembly includes spaced drive rollers for rotating the investment flask on its side, and a pneumatic hammer which engages the side wall of the investment flask for imparting impact energy to the investment flask while the flask is being rotated. The flask is placed in a protective sleeve which more evenly distributes the impact forces around the side wall of the flask during rotation. The sleeve sits on top of the rollers which have resilient cover members. The hammer cooperates with the resilient covers to resonate the flask and loosen the investment material from the sides of the flask. The flask is then removed from the sleeve and placed in the second stage sub-assembly which includes a tubular chamber, and a spring-biased seat in the chamber for receiving the bottom end of the central casting trunk. The chamber includes radial spring arms for centering the casting trunk on the seat. The second stage sub-assembly further includes a vertically oriented pneumatic hammer in engagement with the upper end of the central casting trunk for imparting vertical impact energy to the central trunk. The vertical hammer cooperates with the spring biased seat to cause the casting to resonate and cause the investment molding material to disintegrate apart from the investment casting. As the investment material breaks away from the flask it falls downwardly through the open bottom of the chamber into a waste drum positioned beneath the chamber.

Accordingly, among the objects of the instant invention are: the provision of two-stage investment removal apparatus which effectively and quickly removes investment material from an investment casting flask; the provision of a two-stage investment removal apparatus wherein the investment flask is rotated about a longitudinal axis while impact energy is imparted perpendicular to the rotation axis during a first stage of operation; the provision of a two-stage investment removal apparatus wherein impact energy is imparted to the casting tree along the longitudinal axis of the flask during a second stage of operation; the provision of a two-stage investment removal apparatus wherein the first stage assembly includes a single pneumatic impact hammer operating perpendicular to the axis of rotation; and the provision of a two-stage investment removal apparatus which is less complex, less costly, and more compact in design than the prior art devices.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
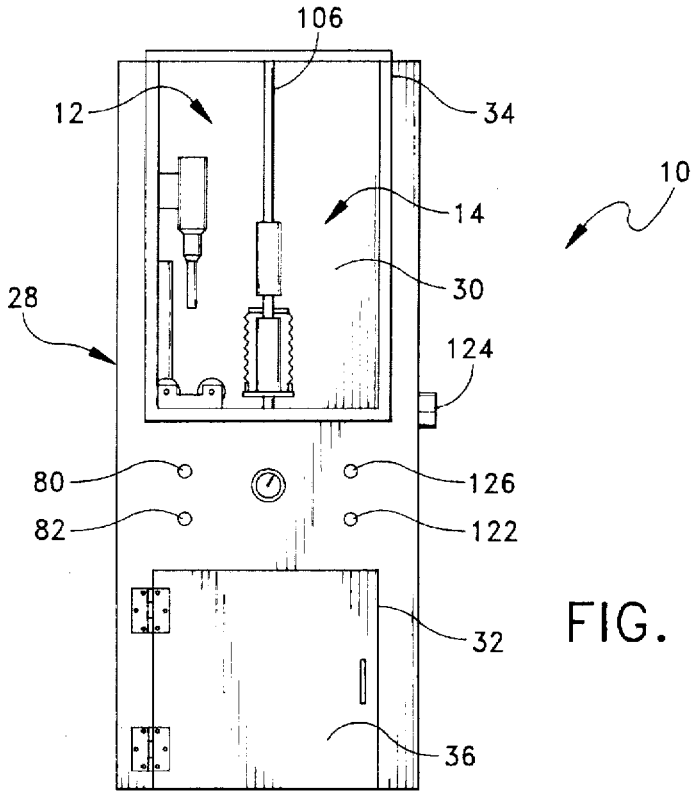
FIG. 1 is a front elevational view of the investment removal apparatus of the instant invention.
Figure 2:
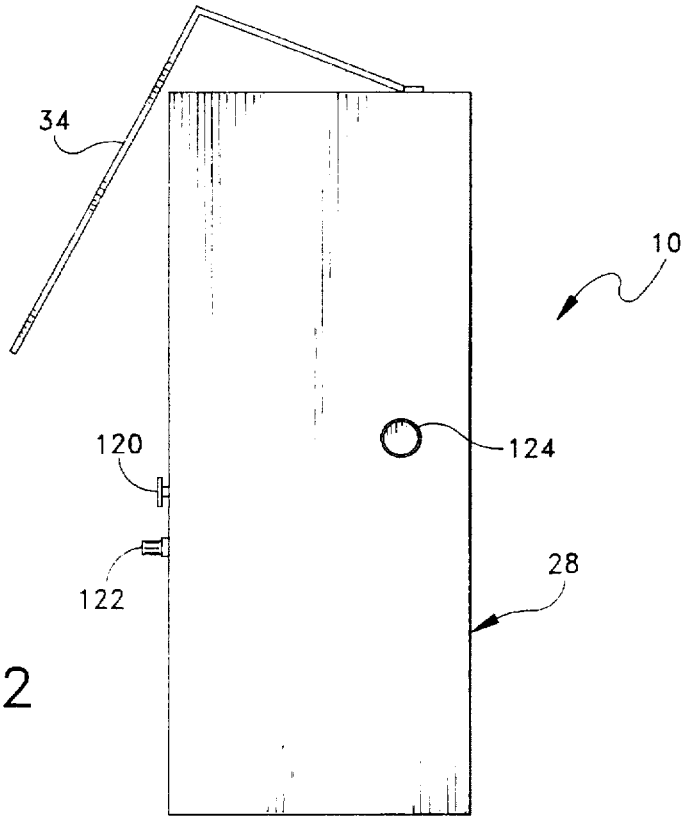
FIG. 2 is a side elevational view thereof.

Referring now to the drawings, the two-stage investment removal apparatus of the instant invention is illustrated and generally indicated at 10 in FIGS. 1–8. As will hereinafter be more fully described, the two-stage investment removal apparatus comprises first and second stage sub-assemblies generally indicated at 12 and 14, which are operative for separate impacting operations to remove investment material from an investment casting generally indicated at 16.

Figure 4:
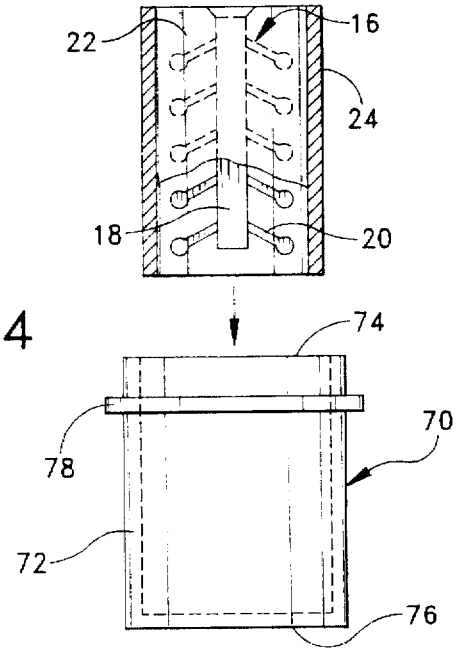
FIG. 4 is a perspective view of the investment flask carrier.

Referring to FIG. 4, the investment casting 16 includes a central trunk 18, and a plurality of gates 20 which hold cast parts. The casting 16 is imbedded within the investment material 22 which has hardened inside a cylindrical investment flask 24.

The first and second stage sub-assemblies 12, 14 are mounted on rigid horizontal base 26 which is mounted within a housing generally indicated at 28. The housing 28 is designed to enclose the first and second stage sub-assemblies 12, 14, to provide acoustical insulation from the noise of the impact devices, and to trap dust and debris within the housing 28. The housing 28 includes an upper opening 30 in which the first and second stage sub-assemblies are located, and a lower opening 32 (FIG. 1) in which an investment collection drum (not shown) is located. The upper opening 30 includes a transparent hinged window 34 which provides access to the first and second stage sub-assemblies 12, 14. The lower opening 32 includes a hinged door 36 which provides access to the investment collection drum.

Figure 3:
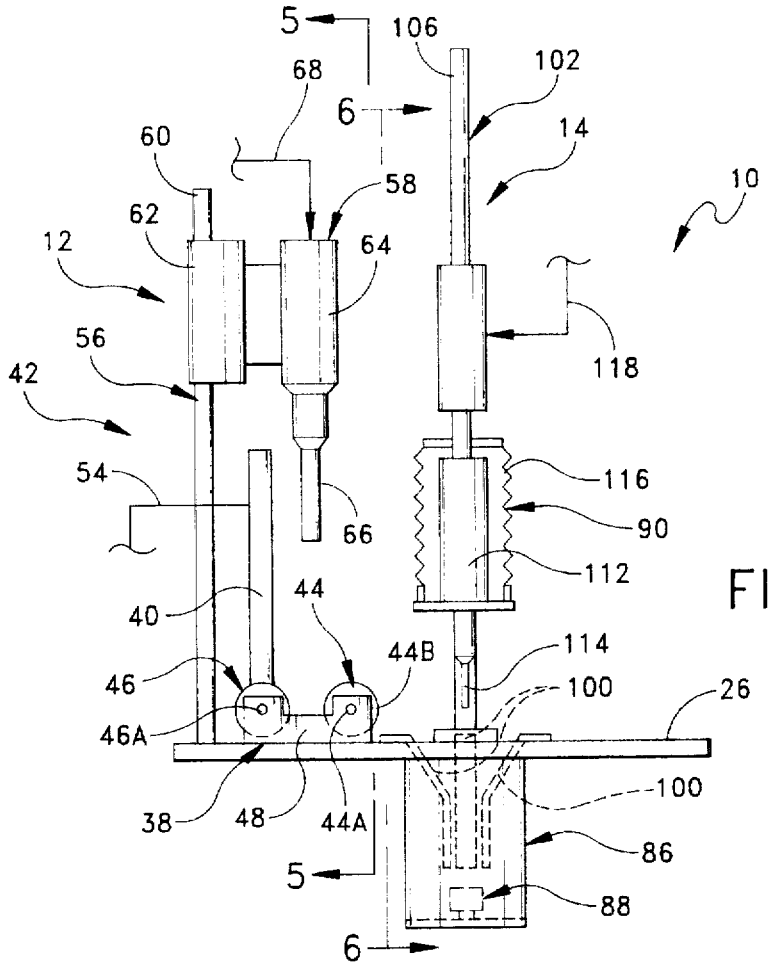
FIG. 3 is an elevational view of the investment removal apparatus with the outer cover removed.
Figure 5:
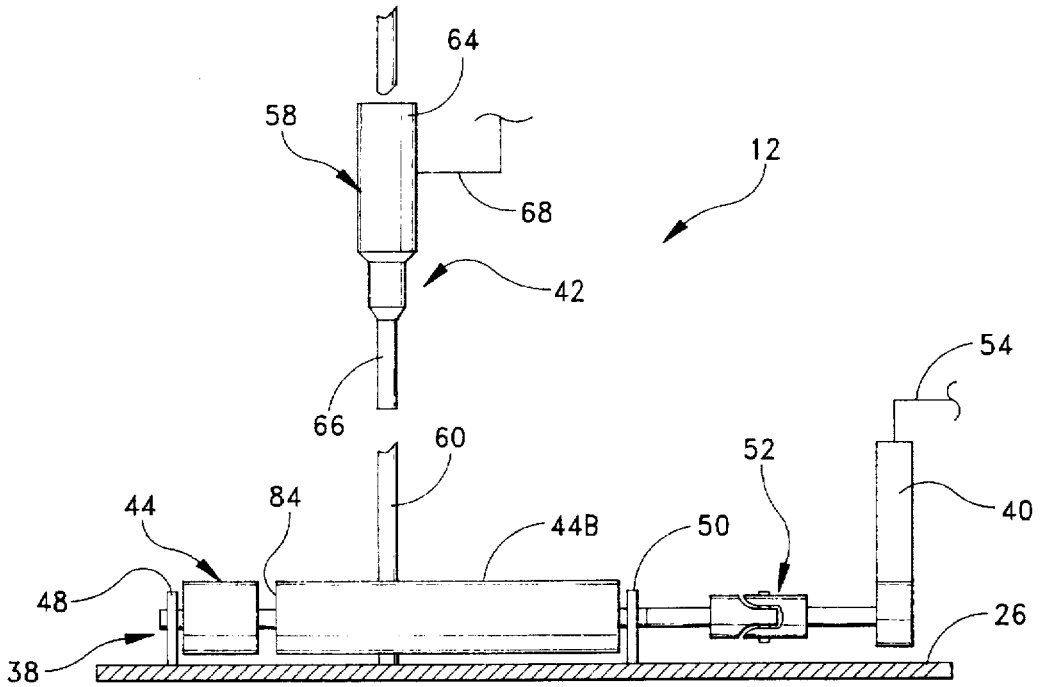
FIG. 5 is a cross-sectional view of the apparatus taken along line 5—5 of FIG. 3 showing the first stage impact assembly.
Figure 6:
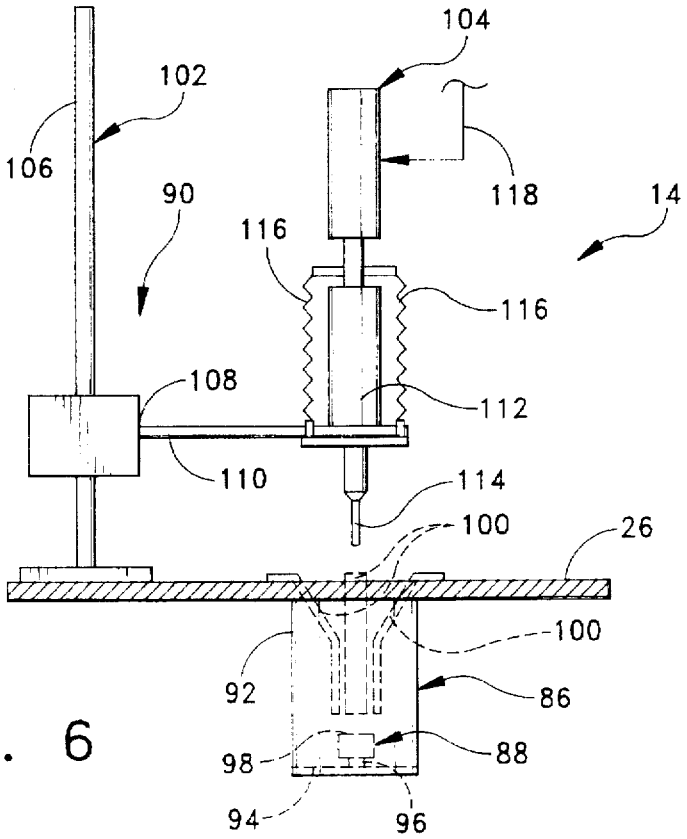
FIG. 6 is another cross-sectional view of the apparatus taken along line 6—6 of FIG. 3 showing the second stage impact assembly and waste container.
Figure 7:
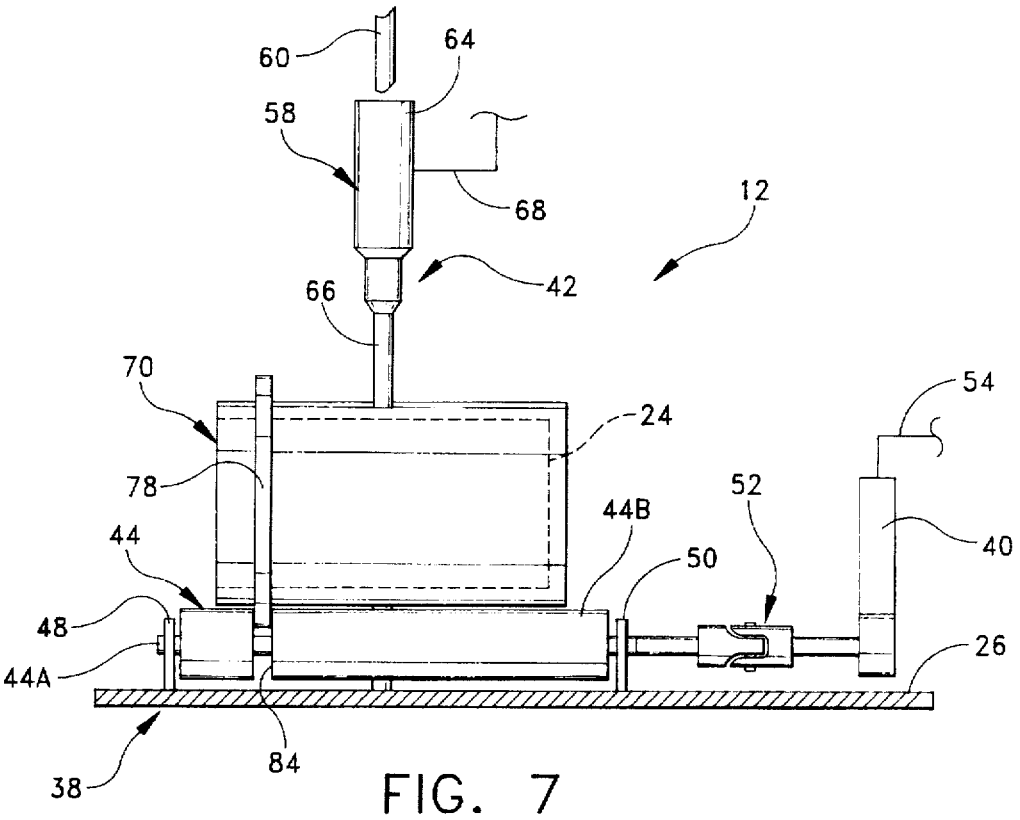
FIG. 7 is a front elevational view of the first stage impact assembly with a flask mounted therein.
Figure 8:
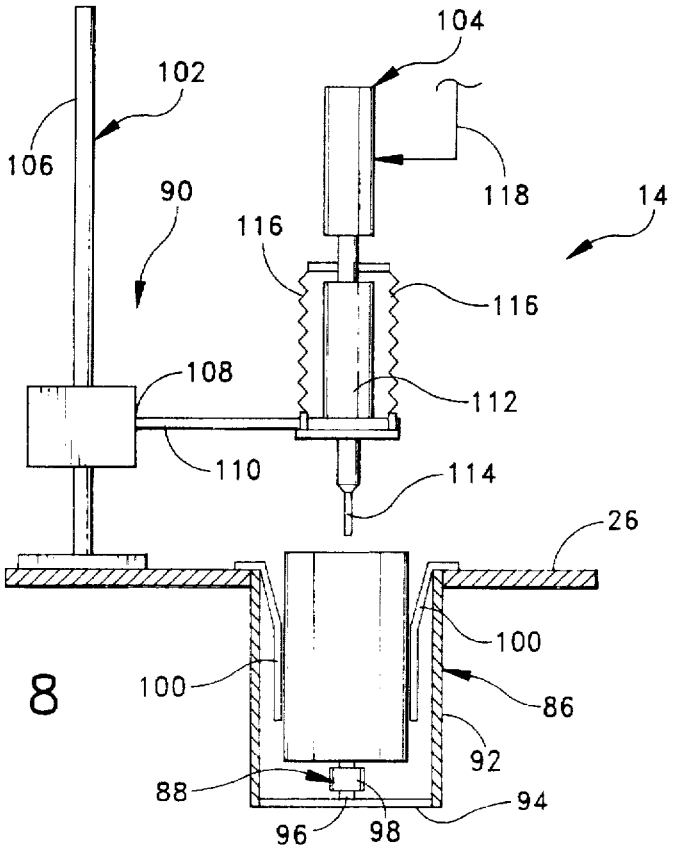
FIG. 8 is a front elevational view of the second stage impact assembly with a flask mounted therein.

The first stage sub-assembly 12 is operative for loosening the investment material 22 from the sides of the investment flask 24. Referring to FIGS. 3, 5, and 7, the first stage sub-assembly 12 includes a roller assembly generally indicated at 38 for rotating the investment flask 24 on its side, a pneumatic motor 40 for driving the roller assembly 38, and a pneumatic hammer assembly generally indicated at 42 which engages the side wall of the investment flask 24 for imparting impact energy to the investment flask 24 while the flask 24 is being rotated. The roller assembly 38 comprises a pair of spaced drive rollers 44, 46 respectively, each having a shaft 44A, 46A which is rotatably mounted between two facing end walls 48, 50 respectively. Each of the rollers 44, 46 includes a resilient cover member 44B, 46B extending along its length. The rollers 44, 46 are driven by the pneumatic motor 40 which is coupled to the shaft 46A of roller 46 by a universal linkage generally indicated at 52. The universal linkage 52 is conventional in the art, and will not be further described herein. The pneumatic motor 40 is driven by an air source (not) shown which is received through a feed line 54. The pneumatic motor 40 is conventional in the art, and will not be described further herein. It is noted that a pneumatic motor 40 is preferred because it can run off of the same air supply as the pneumatic impact devices. Accordingly, the entire apparatus 10 would not require any electric power for operation. Nevertheless, it is to be understood that other motor means, including electric motors, are also acceptable for purposes of the invention.

The pneumatic hammer assembly 42 comprises a vertical guide assembly generally indicated at 56, and a hammer generally indicated at 58. The vertical guide assembly 56 includes an upright guide rail 60 which is attached to the base 26, and a slidable carriage member 62 (FIG. 3) which is fixedly mounted to the hammer 58. Carriage member 62 slidably moves up and down the guide rail for desired positioning of the hammer 58. The hammer 58 includes a body portion 64 and an impact punch 66 which reciprocates up and down during operation. The pneumatic hammer 58 is driven by an air source (not shown) which is provided by feed line 68.

To protect the side wall of the flask 24 from the direct impact of the impact punch 66, the flask 24 is preferably placed in a protective sleeve generally indicated at 70 which more evenly distributes the impact forces around the side wall of the flask during rotation (See FIG. 4). The sleeve 70 comprises a cylinder 72 having an open end 74 and a closed end 76. The sleeve 70 further includes a flange 78 adjacent the open end 74, the purpose of which will be described hereinafter.

Operation of the first stage sub-assembly 12, i.e. the provision of an air flow to the motor 40 and hammer 58, is controlled by a manually actuable control valve (not shown) in the feed lines. It is preferred that both the motor 40 and hammer 58 are fed from a common feed line to permit simultaneous operation. The control valve is operated by a push button 80 mounted on the front of the housing 28 (See FIG. 1). The volume of air passing through the feed line can be controlled by another valve (not shown) in the feed line. The volume control valve is controlled by a rotary knob 82 located on the front of the housing 28 (also see FIG. 1).

In use, the flask 24 is placed into the sleeve 70, and the sleeve 70 is placed on top of the rollers 44, 46 (see FIG. 7). In this regard, the flange 78 rests in a groove 84 formed in the resilient cover members 44B, 46B of the rollers 44, 46. The flange 70 and groove 84 cooperate to maintain uniform rotation of the sleeve 70 on the rollers 44, 46. During operation, the pneumatic motor 40 drives roller 46 to effect rotation of the sleeve 70 and flask 24 while the pneumatic hammer 58 simultaneously drives the impact punch 66 against the outside of the sleeve 70. The hammer 58 cooperates with the resilient covers 44B, 46B to resonate the flask 24 and loosen the investment material 22 from the sides of the flask 24. More specifically, the simultaneous rotation of the sleeve 70, and impact forces of the impact punch 66 effectively loosens the investment material 22 and releases the investment material 22 around the inside perimeter of the flask 24. The flask 24 is then removed from the sleeve 70 and is ready for a second impact operation in the second stage sub-assembly 12.

The second stage sub-assembly 12 comprises a tubular flask chamber generally indicated at 86, a spring-biased seat generally indicated at 88, and a vertical pneumatic hammer assembly generally indicated at 90. The chamber 86 comprises a cylindrical sleeve 92 having open upper and lower ends. The spring-biased seat 88 is mounted on a cross member 94 which extends across the open bottom end of the sleeve 94. The spring-biased seat 88 comprises a post 96, and a seat 98 having a central bore (not shown) which is received over the post 96. A spring (not shown) is captured between the end of the post 96 and the inside end of the bore in the seat 98 to bias the seat 98 upwardly. In use, the flask 24 is received within the chamber 86 with the central casting trunk 18 received onto the spring-biased seat 88. The flask chamber 86 also includes a plurality of radial spring arms 100 for centering the flask 24 and casting trunk 18 on the spring-biased seat 88.

The pneumatic hammer assembly 90 comprises a vertical guide assembly generally indicated at 102, and a hammer assembly generally indicated at 104. The vertical guide assembly 102 includes an upright guide rail 106 which is attached to the base 26, and a slidable carriage member 108 which is fixedly mounted to the hammer assembly 104 by a cross member 110. The carriage member 108 slidably moves up and down the guide rail 106 for positioning of the hammer assembly 104. The hammer assembly 104 includes a body portion 112, an impact punch 114 which reciprocates up and down during operation, and tension springs 116. The tension springs 116 extend between mounts on the body portion 112 and the cross-member 110, and react against the cross member 100 to bias the hammer assembly 104 downwardly. The hammer assembly 104 is driven by an air source (not shown) which is provided by feed line 118.

In operation, the vertical hammer assembly 104 is lowered into engagement with the upper end of the central casting trunk 18 for imparting vertical impact energy to the central trunk 18. The impact punch 114 cooperates with the spring biased seat 88 to cause the casting trunk 18 to resonate within the flask 24 and cause the investment molding material 22 to disintegrate apart from the investment casting 16. As the investment material 22 breaks away from the flask 24 it falls downwardly through the open bottom,of the chamber 86 into a waste drum (not shown) positioned beneath the chamber 86.

Operation of the second stage sub-assembly 14 is controlled by a manually actuable valve (not shown) in the feed line 118. The valve is operated by a push button 120 (FIG. 1) mounted on the front of the housing 28. The volume of air passing through the feed line 118 can be controlled by another valve in the feed line 118. The volume valve is controlled by a rotary knob 122 located on the front of the housing 28.

It is noted that during the investment removal process, a significant amount of dust is created. In this regard, the housing 28 is provided with an exhaust port 124 in which a filter bag (not shown) is mounted. The volume of air generated by operation of the pneumatic hammers and motor is sufficient to create a positive air flow out of the housing 28 through the exhaust port 124. Accordingly, any dust created during the process, is carried out of the interior of the housing 28 through the exhaust port 124 and is trapped in the filter. Obviously, the larger pieces of investment debris 22 fall downwardly through the chamber 86 into the waste drum.

It can therefore be seen that instant invention provides an effective device and method for removing investment material from an investment casting. As described hereinabove, the general method for removing the investment material comprises the steps of rotating the flask 24 while simultaneously imparting impact energy to the side walls of the flask to loosen the investment material, and thereafter imparting vertical impact energy to the casting trunk 18 to remove the investment material from between the flask walls and the casting 16. The two stage method of the instant invention is highly effective in removing the investment material from the flask using a simple two-stage apparatus. The present apparatus 10 is greatly simplified from the prior art embodiment, and offers an economic and space advantage over the prior art devices while performing the same function. For these reasons, the instant invention is believed to represent a significant advancement in the investment removal art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A two-stage investment removal apparatus for removing investment material from a tree-shaped investment casting having a central trunk and a plurality of cast parts attached to said trunk by gates, said investment casting being cast in an open-ended cylindrical flask having an investment mold therein, said apparatus comprising:

a first stage sub-assembly including means for rotating said investment flask about a longitudinal axis which extends through said trunk, and impact means in engagement with said investment flask for imparting impact energy to said investment flask while said flask is being rotated; and a second stage sub-assembly including a spring-biased seating means for receiving a first end of said central trunk when said flask is disposed on said seating means, centering means for centering said trunk on said seating means, and vertical impact means in engagement with a second end of said central trunk for imparting vertical impact energy to said central trunk, said vertical impact means cooperating with said spring biased seating means to cause said investment casting to resiliently resonate and cause said investment material to disintegrate apart from said investment casting.

2. The apparatus of claim 1 wherein said means for rotating said investment flask comprises a pair of spaced, generally horizontal rollers, and means for rotating one of said rollers.

3. The apparatus of claim 2 wherein said rollers include a resilient cover member, said resilient cover members cooperating with said impact means to partially cushion said impact energy and to cause said investment flask to resiliently resonate.

4. The apparatus of claim 1 further comprising a cylindrical protective sleeve in which said flask is positioned during rotation in said first stage sub-assembly.

5. The apparatus of claim 3 further comprising a cylindrical protective sleeve in which said flask is positioned during rotation in said first stage sub-assembly.

6. The apparatus of claim 5 wherein said protective sleeve includes an annular outwardly extending flange which is received in aligned-grooves in said cover members on said rollers, said flange and grooves cooperating to maintain said sleeve in proper registration with said rollers during rotation thereof.

7. The apparatus of claim 1 wherein said second stage sub-assembly further comprises a tubular flask chamber having upper and lower ends, said centering means comprising a plurality of spring arms extending radially inwardly from side walls of said tubular flask chamber.

8. The apparatus of claim 7 wherein said means for rotating said investment flask comprises a pair of spaced, generally horizontal rollers, and means for rotating one of said rollers.

9. The apparatus of claim 8 wherein said rollers include a resilient cover member, said resilient cover members cooperating with said impact means to partially cushion said impact energy and to cause said investment flask to resiliently resonate.

10. The apparatus of claim 7 further comprising a cylindrical protective sleeve in which said flask is positioned during rotation in said first stage sub-assembly.

11. The apparatus of claim 9 further comprising a cylindrical protective sleeve in which said flask is positioned during rotation in said first stage sub-assembly.

12. The apparatus of claim 11 wherein said protective sleeve includes an annular outwardly extending flange which is received in aligned grooves in said cover members on said rollers, said flange and grooves cooperating to maintain said sleeve in proper registration with said rollers during rotation thereof.

13. A two-step method for removing investment material from an investment flask comprising the steps of:

rotating the investment flask while simultaneously imparting impact energy to a side wall of the flask to loosen the investment material from the side wall of the flask; and imparting impact energy along a longitudinal axis of a casting trunk within the flask to resonate the casting trunk relative to the flask, whereby the investment material is disintegrated from the casting trunk.

* * * * *